US008573017B2

(12) United States Patent
Diehl et al.

(10) Patent No.: US 8,573,017 B2
(45) Date of Patent: Nov. 5, 2013

(54) DEVICE FOR HANDLING AND/OR TRANSPORTING BACK-UP ROLLS AND/OR WORK ROLLS OF A ROLL STAND AT LEAST IN PAIRS

(75) Inventors: Christian Diehl, Hilchenbach (DE); Markus Wagener, Netphen (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 0 days.

(21) Appl. No.: 13/643,356

(22) PCT Filed: Apr. 8, 2011

(86) PCT No.: PCT/EP2011/055491
§ 371 (c)(1),
(2), (4) Date: Nov. 28, 2012

(87) PCT Pub. No.: WO2011/134771
PCT Pub. Date: Nov. 3, 2011

(65) Prior Publication Data

US 2013/0067979 A1 Mar. 21, 2013

(30) Foreign Application Priority Data

Apr. 26, 2010 (DE) ..... 10 2010 018 371
Sep. 24, 2010 (DE) ..... 10 2010 046 476

(51) Int. Cl.
*B21B 31/08* (2006.01)

(52) U.S. Cl.
USPC ..... 72/239

(58) Field of Classification Search
USPC ..... 72/237, 238, 239, 446; 164/441, 442
See application file for complete search history.

(56) References Cited

U.S. PATENT DOCUMENTS

| | | | | |
|---|---|---|---|---|
| 3,975,938 | A * | 8/1976 | Schmidt et al. | 72/239 |
| 4,435,970 | A * | 3/1984 | Sekiya | 72/239 |
| 4,510,783 | A | 4/1985 | Roemmen | |
| 6,763,565 | B2 * | 7/2004 | Mukaigawa et al. | 29/426.1 |
| 8,201,431 | B2 | 6/2012 | Blecher | |
| 2009/0019909 | A1 * | 1/2009 | Blecher | 72/238 |

FOREIGN PATENT DOCUMENTS

| | | |
|---|---|---|
| JP | 49-14984 | 4/1974 |
| JP | 52-133061 | 11/1977 |
| JP | 53-146952 | 8/1993 |
| WO | 2007/080088 | 7/2007 |

* cited by examiner

*Primary Examiner* — Teresa M Ekiert
(74) *Attorney, Agent, or Firm* — Abelman, Frayne & Schwab

(57) ABSTRACT

The invention relates to a device for handling and/or transporting back-up rolls and/or work rolls (4*a*, 4*b*) of a roll stand, preferably at least in pairs, especially in sets, between the roll stand arranged in a roll ball and a roll workshop, and in the roll workshop. Said device comprise a roll-changing pit that extends transversely to the roll direction of the roll stand, form the roll stand towards the roll workshop, and has displacement devices for at least one pair or set of dismantled back-up or work rolls (4*a*, 4*b*), and a roll-changing stand (8) that is arranged transversely to the roll-changing pit in the roll workshop and can be moved across said pit in or away from the roll direction of the roll stand. The aim of the invention is to enable the time required for a back-up roll change to be reduced and the back-up roll change to be simplified. To this end, the roll-changing stand (8) comprises two roll-receiving regions (13, 14) that have an especially U-shaped cross-section and are arranged at a distance from each other in the roll direction of the roll stand, said regions each comprising both bearing surfaces (15, 16) for receiving work rolls (4*a*, 4*b*) and bearing surfaces (17, 18) for receiving back-up rolls.

6 Claims, 7 Drawing Sheets

Figure 1:
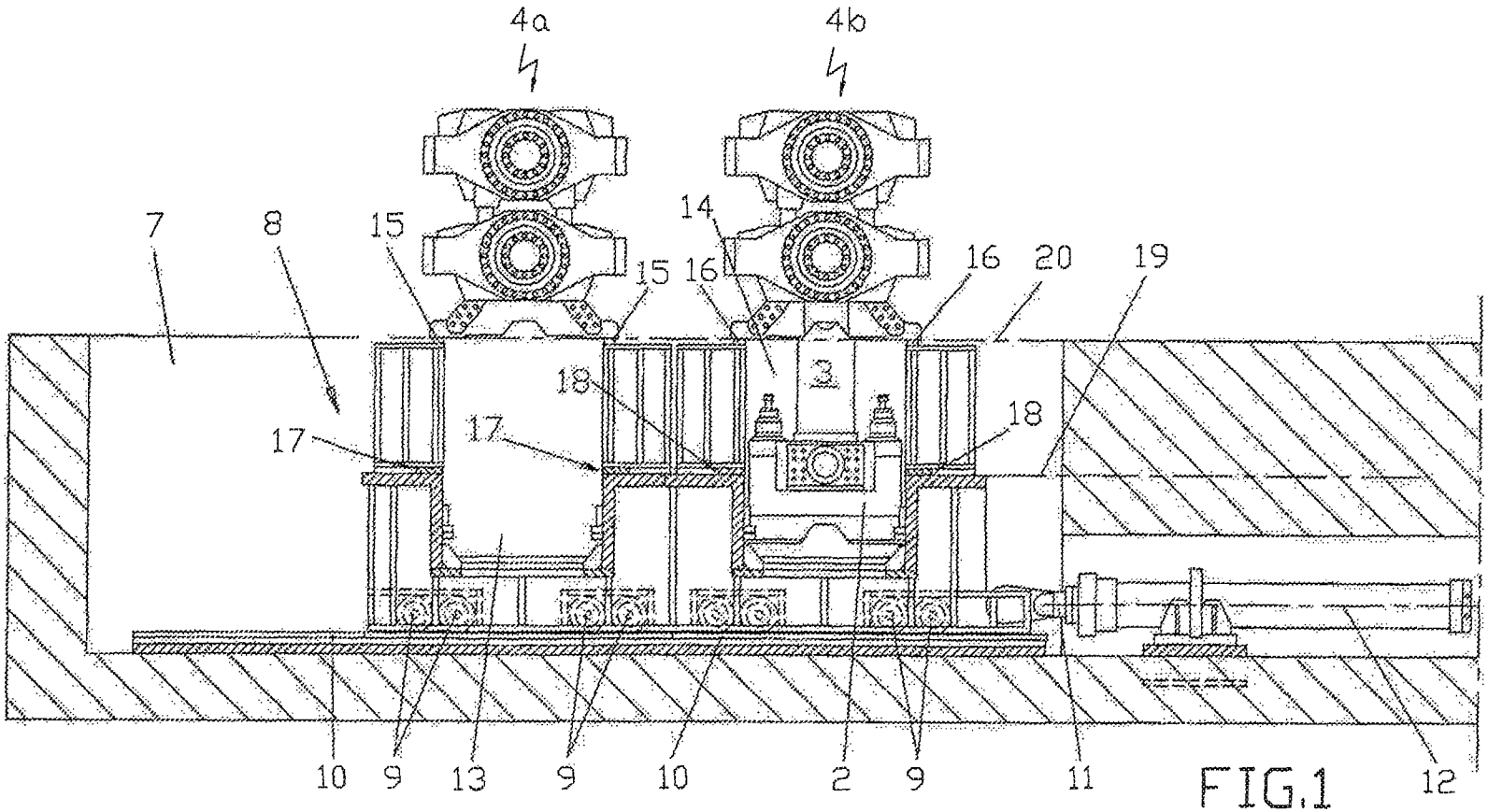

DEVICE FOR HANDLING AND/OR TRANSPORTING BACK-UP ROLLS AND/OR WORK ROLLS OF A ROLL STAND AT LEAST IN PAIRS

The invention relates to a device for handling and/or transporting backup rolls and/or work rolls of a roll stand, preferably at least in pairs, especially in sets, between the roll stand arranged in a roll hall and between a roll workshop as well as in the roll workshop, comprising a roll-changing pit running transversely to the roll direction of the roll stand from the roll stand towards the roll workshop, with displacement devices for at least one pair or a set of dismantled backup rolls or work rolls, and comprising a roll-changing stand that can move in the roll workshop transversely to the roll-changing pit and across it as well as in or counter to the roll direction of the roll stand.

Roll stands for the rolling of steel slabs or steel sheets have, for example, a set of work rolls consisting of a pair of work rolls and have a backup roll arranged above and one below a work roll. If the work rolls and/or the backup rolls are worn, they must be replaced. To this end different devices are known with which the backup rolls or work rolls moved out of the roll stand are moved out of the roll hall into the roll workshop as well as in the roll workshop. Also roll sets worked by such devices in the roll workshop are resupplied to the particular roll stand as a new, ground roll set.

Such a generic device is known from EP 1 954 416 B1. This known device comprises a roll-changing pit running transversely to the rolling direction of the roll stand from the roll stand toward the roll workshop. A moving device guided on rails and in the form of a hydraulically driven locomotive is arranged in this roll-changing pit. On the one hand, a set of work rolls dismantled from the associated roll stand can be coupled to this locomotive and moved in the coupled state from the roll hall into the roll workshop and back again later if desired into the roll hall to the roll stand. On the other hand, a set of backup rolls of the roll stand can also be coupled to this moving device and moved along the roll-changing pit from the roll hall into the roll workshop and back again if desired. In order to be able to avoid stand changing times, it is furthermore known from this document that a roll-changing stand can be moved in the direction transversely to the roll-changing pit as well as in or counter to the roll direction of the roll stand, which roll-changing stand can receive several sets of work rolls. As a result, it becomes possible to make available on the particular roll stand a set of new work rolls even during the operation of the roll stand as well as to park a dismantled set of work rolls immediately after its dismantling in the roll workshop. In this manner, it is possible to use the roll-changing pit at first for the dismantling of work rolls but then to make it immediately available for the dismantling and insertion of a set of backup rolls.

A disadvantage of this prior art is the fact that the backup rolls are moved in and out exclusively on the same tracks, namely, those of the roll-changing pit. This means that a backup roll moved out from the roll stand or a set of backup rolls moved out of the roll stand must be removed at first with the aid of a lifting device, for example, a hall crane, from the track of the moving device in order that the track is prepared for receiving new backup rolls or a new set of backup rolls. This raising and lowering of backup rolls or sets of backup rolls during the replacement of backup rolls is work-intensive and time-intensive. This results in longer replacement times for backup rolls, which negatively influences the productivity of the roll system.

The invention therefore has the basic problem of creating a solution that makes it possible to reduce the time required for a backup roll replacement and to simplify the backup roll replacement.

In a device of the type initially designated in detail this problem is solved in accordance with the invention in that the roll replacement stand comprises two roll receiving areas that are arranged at a distance from one another in the rolling direction of the roll stand and that are constructed in particular in a U shape in cross section, which areas comprise support surfaces for receiving work rolls as well as comprise support surfaces for receiving backup rolls.

Thus, the invention provides that the device for handling/manipulating and/or transporting dismantled backup rolls and/or work rolls of a work stand comprises a roll replacement stand, that can be shifted or moved transversely to the roll stand and to the roll-changing pit or comprises a transfer shifting platform so that this part of the replacement device or this roll replacement device can not only transversely shift the work rolls but also or additionally the backup rolls. This achieves a reduction of the times for the replacement of backup rolls as well as a simplification of the replacement of support rolls in roll stands.

The invention is advantageously distinguished in a further development in that the areas for receiving rolls are distanced in such a manner that a pair or a set of superposed work rolls and/or backup rolls can be arranged adjacent to each other in them at the same time. This makes it possible to provide a roll replacement stand comprising only two roll receiving areas into which stand two sets of work rolls or two sets of backup rolls or one set of backup rolls and one set of work rolls can be arranged selectively adjacent to each other. As a result of this flexibility, it is sufficient for carrying out a roll replacement to provide to provide a roll-changing stand with only two receiving areas or to provide a transverse shifting platform with two receiving areas, which brings about an easily understandable expense for construction and investment.

Since the work rolls and the backup rolls differ as a rule in diameter, it is furthermore purposeful and advantageous for the construction of a device in accordance with the invention that the roll receiving areas are distanced in such a manner that a pair or set of superposed work rolls and/or backup rolls can be arranged adjacent to each other in the latter at the same time, which the invention also provides. In order to be able to receive backup rolls as well as work rolls, the invention is further distinguished in that each roll receiving area comprises an upper support area or moving area arranged at the work roll replacement level of the roll stand and comprises a lower support area or moving area arranged under the latter at the backup roll replacement level of the roll stand and on the moving level of the roll-changing pit, and that a roll receiving area can be brought in a traveling-over and/or moving position relative to the roll-changing pit. It is possible with this design in accordance with the invention, for example, to place a set of work rolls on the upper support area or moving area of a roll receiving area and to then move or shift this roller receiving area into a traveling-over position and/or moving position relative to the roll-changing pit, in which position a locomotive can then travel over this roll receiving area or can at least couple onto the work roller set. It is also possible to place a backup roller set on the lower support area or moving area and to bring this roller receiving area into a moving position with the roll-changing pit so that a locomotive that can be moved in the roll-changing pit can couple onto the backup roller set and move it out of the roll replacement stand and pull it along the roll-changing pit to the roll stand. To this end the invention is furthermore distinguished in that a locomotive movably arranged in the roll-changing pit can be moved into the roll receiving area when the roll receiving area is located in the traveling-over position or moving position or can be coupled to a set of backup rolls or work rolls arranged in the roll receiving area. A particular set of backup rolls or set of work rolls can be pushed back and forth by the locomotive or backup rolls or work rolls can be pushed back and forth between an associated roll stand and the roll workshop.

In order to ensure the necessary ability to shift or move the roll replacement stand transversely the invention furthermore provides that the roll replacement stand is movably mounted on the bottom of a pit.

It is furthermore advantageous here, in particular to make it possible to move in and out of the roll-changing pit if the bottom level of the pit is formed underneath the bottom level of the roll-changing pit. The wheels that make it possible to move the roll replacement stand can then be positioned below the bottom level of the roll-changing pit so that the lower support area or moving area of the roll receiving areas nevertheless remains readily accessible from the roll-changing pit.

Finally, the invention is distinguished in that the roll-changing pit has a displacement cross section that receives the diameter of the backup rolls. It is possible on account of this dimensioning to move back or to shift/transport a set of backup rolls from the roll hall along the roll-changing pit into the roll workshop.

Figure 2:
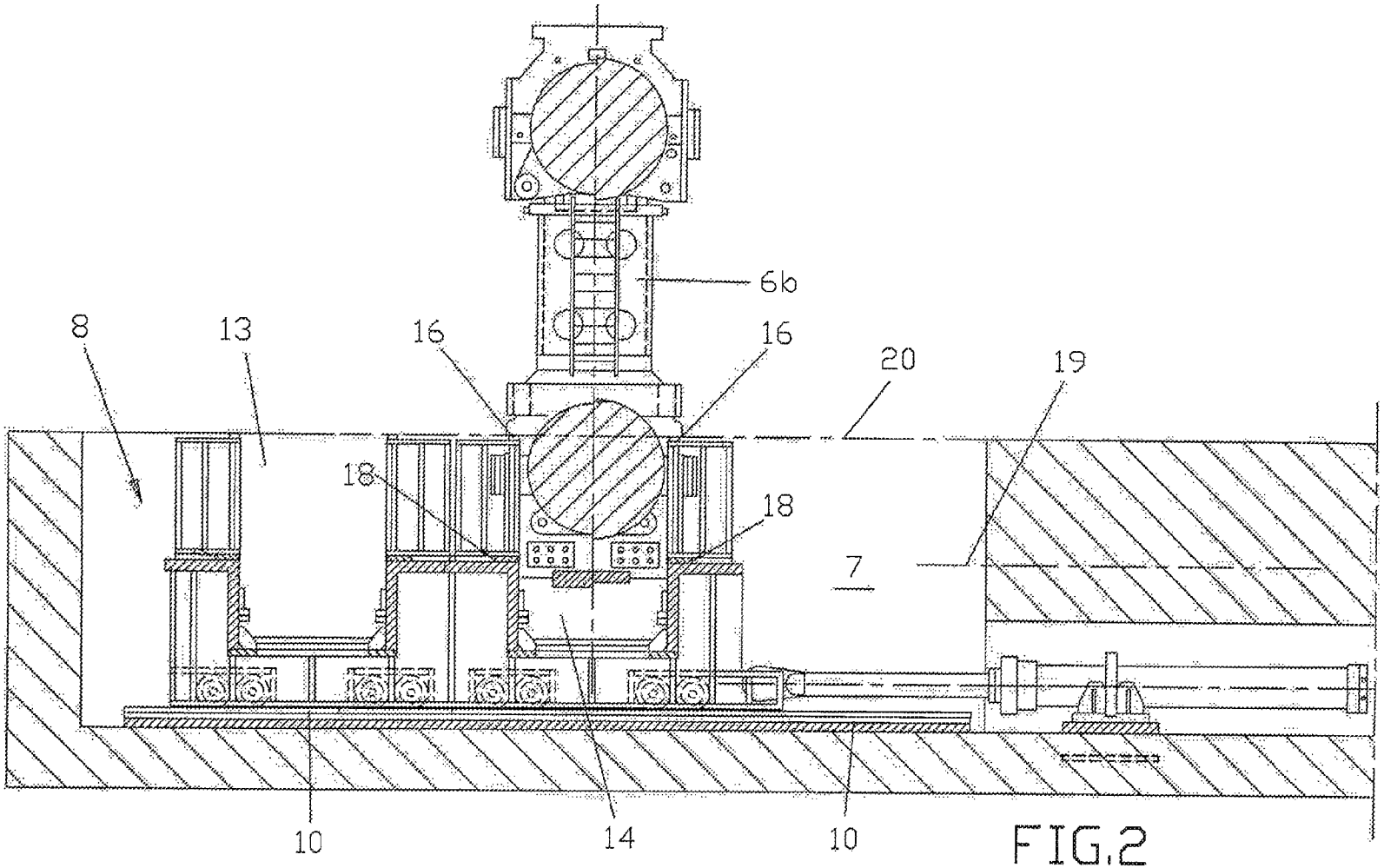
Figure 3:
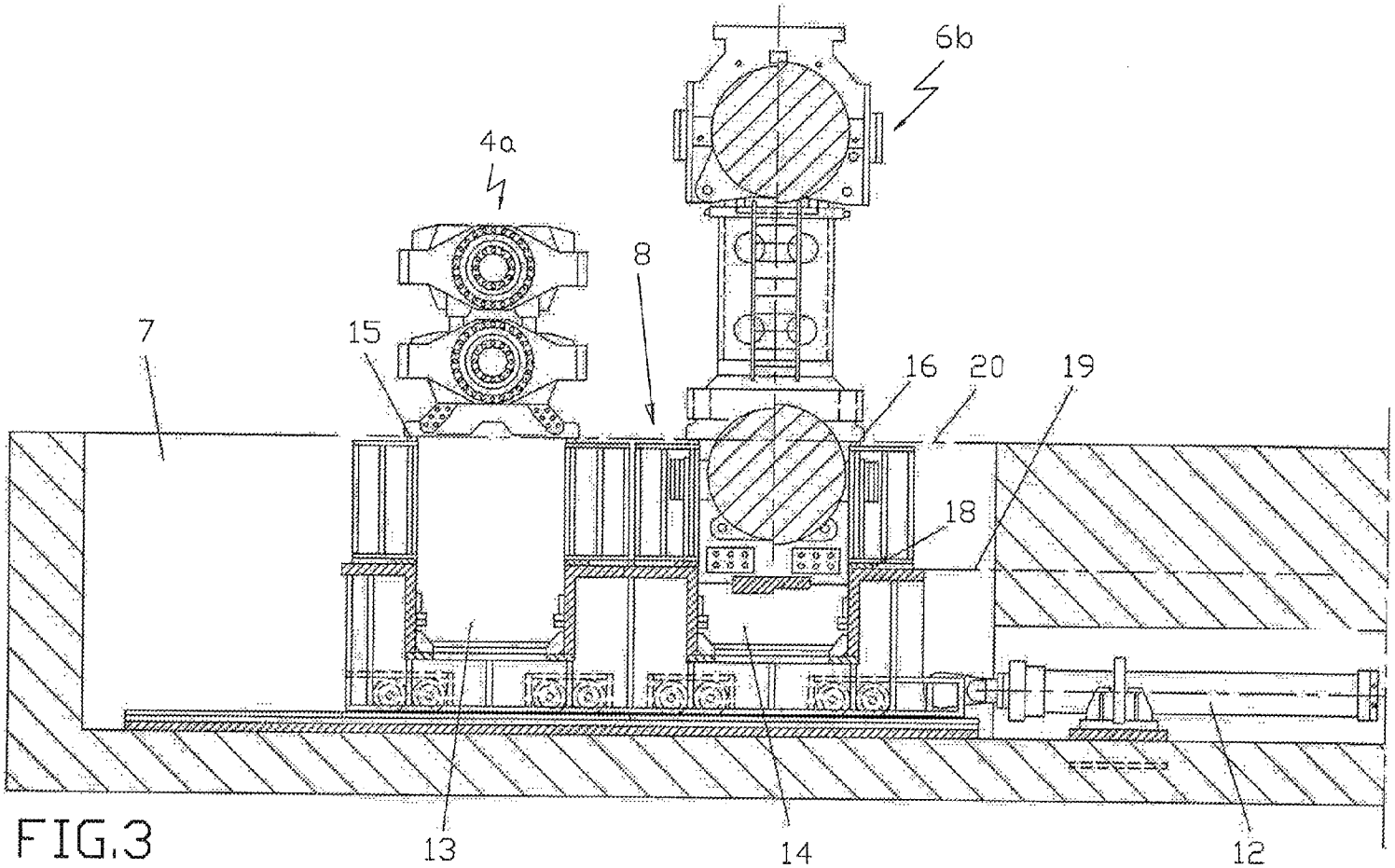
Figure 4:
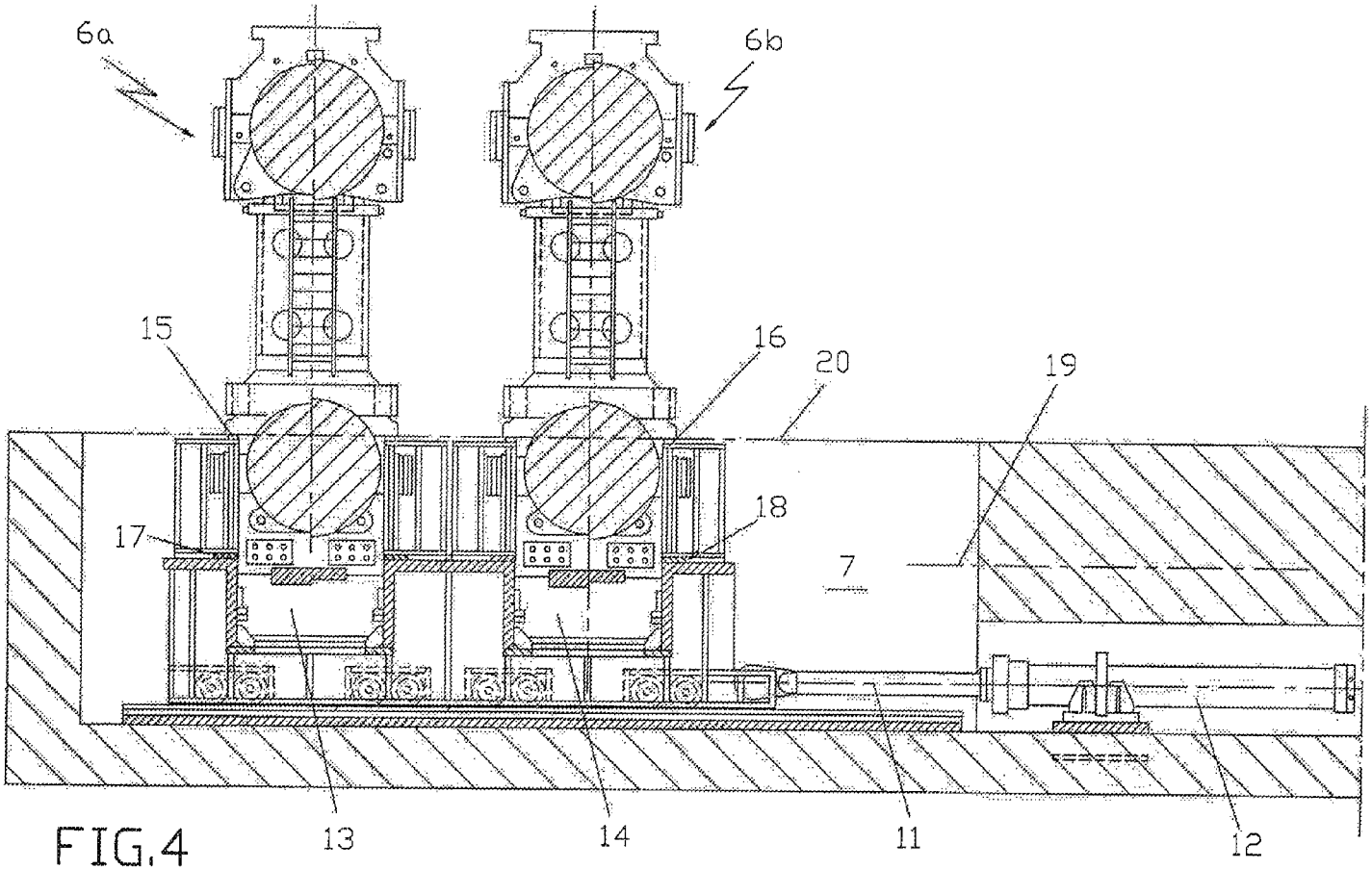
Figure 5:
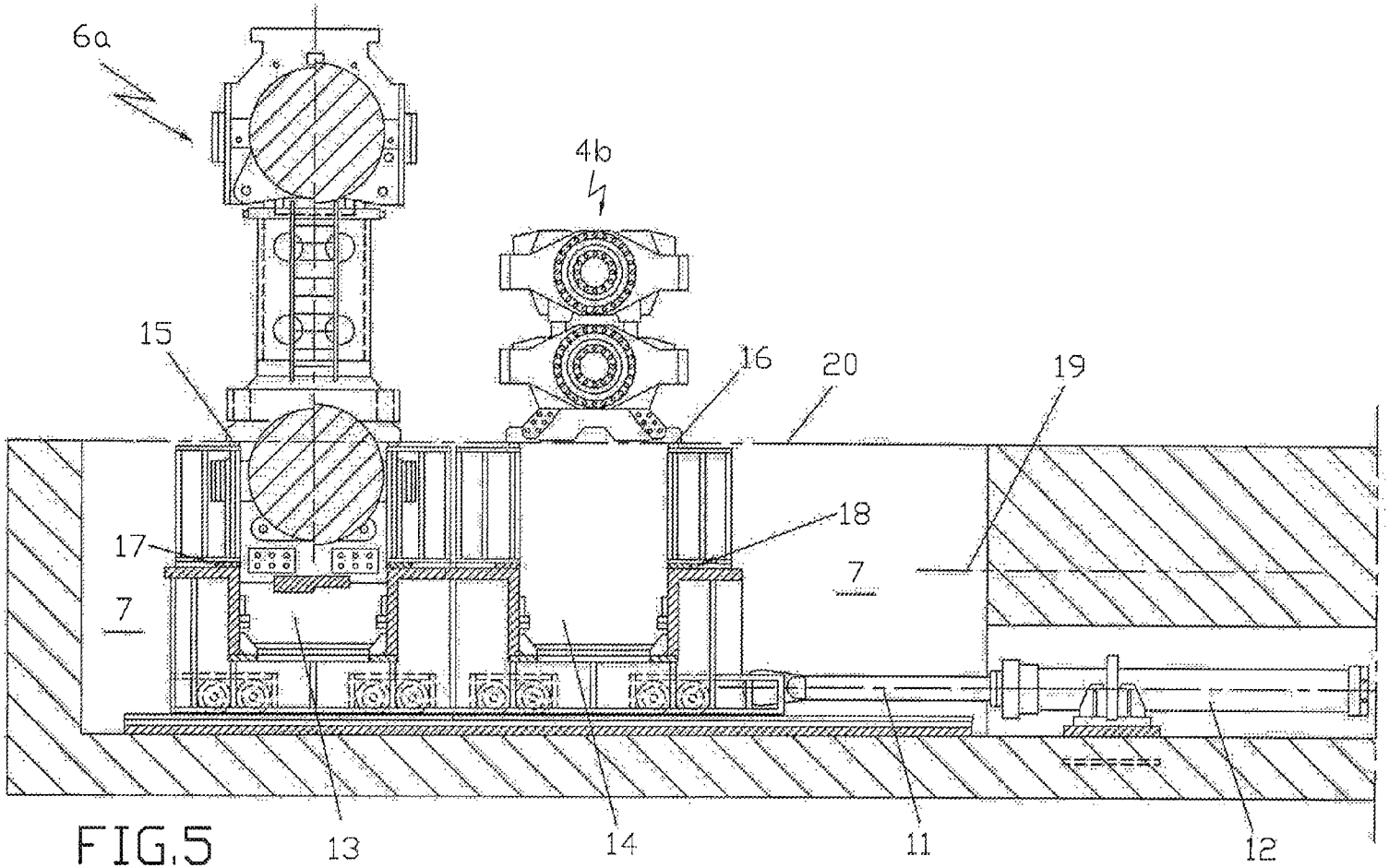
Figure 6:
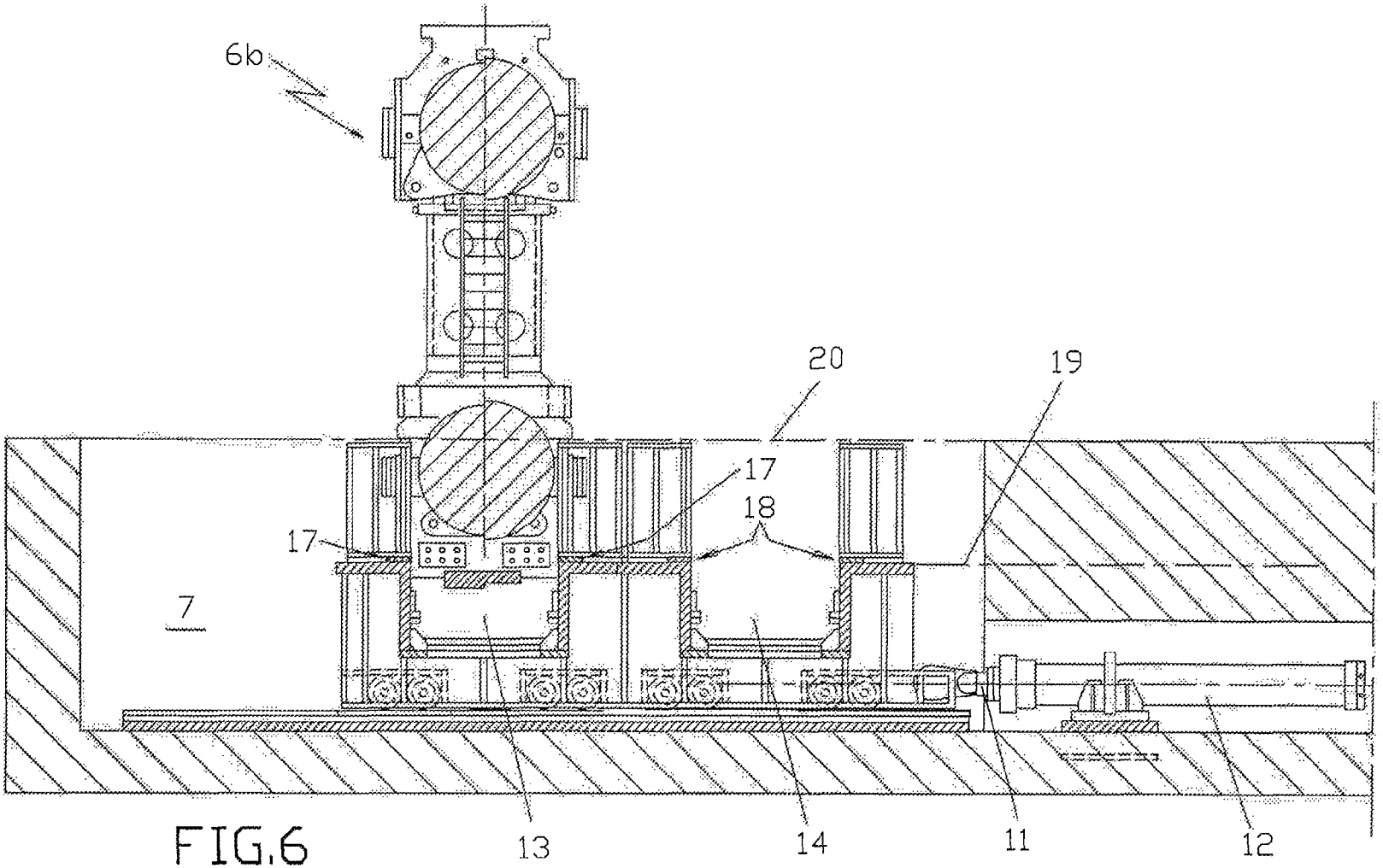

The invention is described in detail by way of example using the drawings. In the drawings FIG. 1 shows a cross-sectional view of a roll replacement stand, FIG. 1*a* shows a cross-sectional view of the roll-changing pit arranged vertically to the roll replacement stand and with a locomotive arranged in it, FIG. 2 shows the roll replacement stand in a cross-sectional view with an inserted new set of backup rolls in a moving position to the roll-changing pit, FIG. 3 shows a cross-sectional view of the roll replacement stand with an inserted new set of backup rolls in a roll receiving area and shows the other roll receiving area with an inserted old set of work rolls in a moving position to the roll-changing pit, FIG. 4 shows a cross-sectional view of a roll receiving area with an inserted new set of backup rollers and shows a roll receiving area with an old set of backup rolls moved in, FIG. 5 shows a cross-sectional view of a roll receiving area with an inserted old set of backup rolls and shows the other roll receiving area with an inserted new set of work rolls in the moving position, and FIG. 6 shows a cross-sectional view of the roll receiving area with an inserted old set of backup rolls in a dismantled position.

A roll system or train of rolls comprising at least one roll stand is present in a roll hall in a manner that is not shown. This at least one roll stand comprises a set of work rolls and a set of backup rolls. A roll-changing pit 1 running from the roll hall with the roll stand into a roll workshop runs from this roll stand transversely and vertically to the rolling direction of the roll system, the end area of which roll-changing pit is shown on the roll workshop side in FIG. 1*a*. A hydraulically moved locomotive to is arranged so that it can shift longitudinally in a customary manner in the roll-changing pit 1, whereby the shifting movement takes place, for example, by means of a pushing and pulling cylinder with a connected pushing and pulling rod. The locomotive 2 comprises a coupling or attaching element 3 for attaching the locomotive 2 to a set of work rolls 4*a*, 4*b* pushed out of the roll stand or to be pushed into the latter as well as comprises other coupling or attaching elements 5*a*. 5*b* that can be attached to a set of backup rolls 6*a* moved out of the roll stand or can be coupled to a set of backup rolls 6*b* to be moved into the roll stand.

Figure 1A:
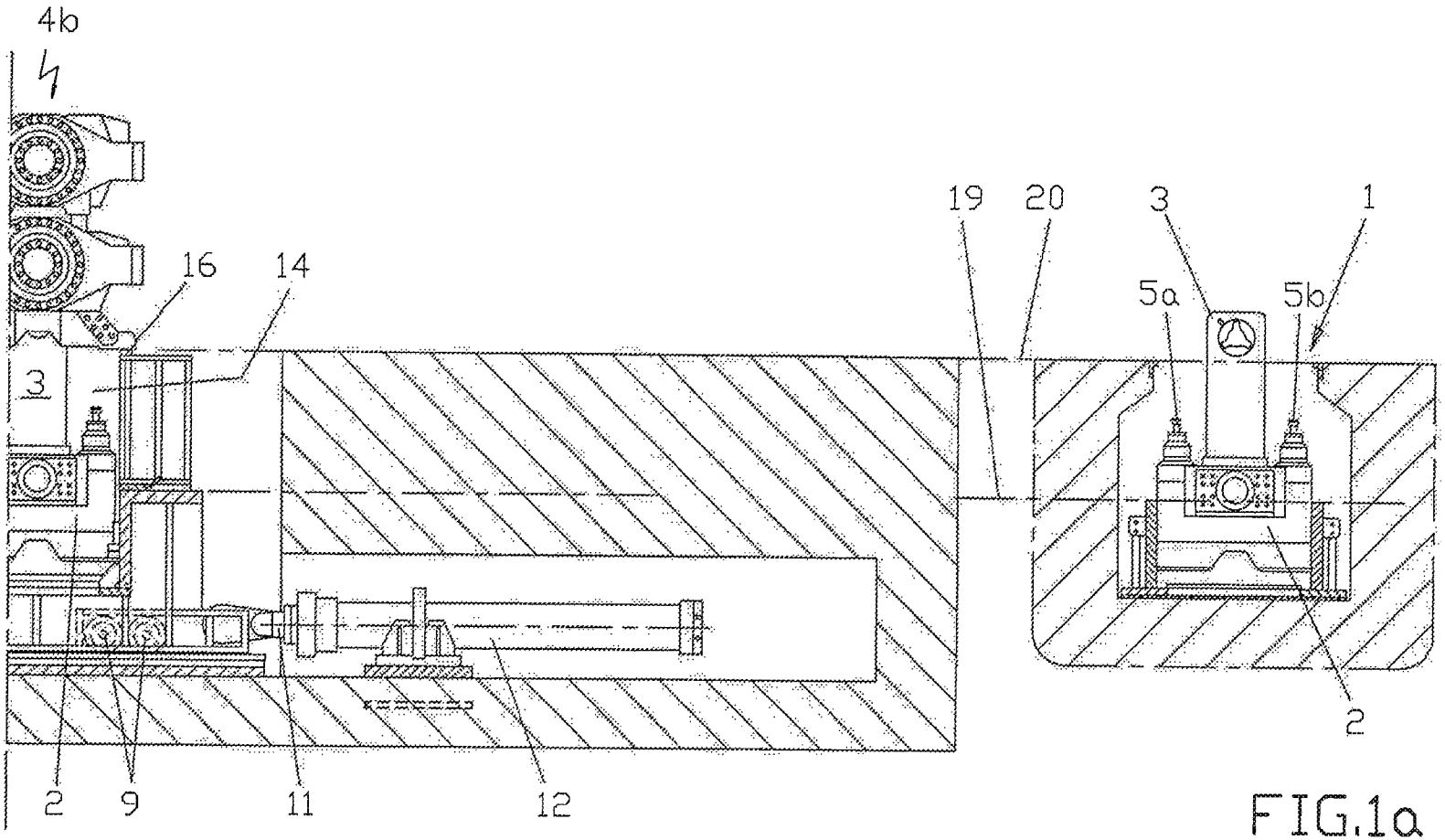

As is apparent from the left partial image of FIG. 1*a* but in particular from the FIG. 1, a pit 7 is formed in the roll workshop on the bottom of which pit a roll-changing stand 8 can move transversely to the roll-changing pit 1 and can move across it. To this end the roll-changing stand 8 is provided on the bottom with running wheels 9 that roll on tracks 10 arranged on the bottom of the pit 7. The roll-changing stand 8 can move on these tracks 10 with the aid of a coupled traction and pressure rod 11 that can be moved by a hydraulic cylinder 12. The roll-changing stand 8 can move back and forth in pit 7 from a right position shown in FIG. 1 into a left position shown in FIG. 2 and can therefore move in as well as counter to the roll direction of the roll stand.

The roll-changing stand 8 comprises two roll receiving areas 13, 14 that are constructed substantially in a U-shape in cross section and that are distanced so far from one another that sets of backup rollers as well as sets of work rollers can be received by them at the same time, and held. Each roll receiving area, 13, 14 comprises an upper support or moving area 15, 16 that is arranged on the work roller replacement level 20 of the roll stand and that consists of rail tracks that are arranged on opposite edge areas of the particular roll receiving area, 13, 14 and aligned in the direction of the roll-changing pit 1. Sets of work rolls 4*a*, 4*b* can be movably set on these rail tracks or upper support or moving areas 15, 16. To this extent these upper support or moving areas 15, 16 form support surfaces for receiving work rolls or sets of work rolls 4*a*, 4*b*. Furthermore, the roll receiving ranges 13, 14 comprise lower support or moving areas 17, 18 that are arranged and formed under the upper support—or moving areas 15, 16 and that are arranged at the backup roll replacement level 19 of the roll stand as well as at the level of the moving level of the roll-changing pit 1, which level is formed by this backup roll replacement level 19, and therewith on the locomotive 2 moved in it. Therefore, the lower support or moving areas 17, 18, that form support surfaces for receiving backup rolls or sets or backup rolls 6*a*, 6*b* can be brought into a traveling-over and/or moving position relative to the roll-changing pit 1, in which pit the roll receiving area 13, 14 associated with the roll-changing pit 1 can be traveled over by the locomotive 2, as is shown in FIG. 1. In this position shown the locomotive 2 is moved into the roll receiving area 14 on the right in the image and moves in this manner the new set of work rolls 4*b* coupled via the coupling or attachment element 3 from the roll-changing stand 8 to the roll stand. As can be seen from the FIGS. 1 and 1*a* the bottom level of the pit 7 is located below the bottom level of the roll-changing pit 1. As is shown in the other FIGS. 3-6 sets of backup rolls 6*a*, 6*b* should be positioned in the roll-changing stand 8 in such a manner that they can be handled and are moved by the locomotive 2 into one of the receiving areas 13, 14 and/or moved out of one of the roller receiving areas 13, 14. The sets of backup rolls 6*a*, 6*b* are moved toward the roll stand or away from the roll stand in the roll-changing pit 1 just as the sets of work rolls 4*a*, 4*b* by the locomotive 2, for which reason the roll-changing pit 1 has a movement cross section that receives the diameter of the backup rolls.

FIG. 2 shows the roll-changing stand 8 with a new set of backup rolls 6*b* inserted into the roller receiving area 14, which set is mounted at this position in the roll workshop. The roll-changing stand 8, also designated as changing platform or transfer shifting platform, is located at a position in which the roll receiving area 14 is positioned covering the roll-changing pit 1 in an aligned manner so that the roll-changing stand 8 is positioned in a traveling-over position and/or moving position relative to the roll-changing pit 1. In this position the set 6 of backup rollers can now be coupled to the locomotive and drawn by it along the roll-changing pit 1 to the roll stand. If a change of working rolls should be required during the mounting of the set 6*b* of backup rollers, the roll-changing stand 8 is moved into the position shown in FIG. 3. In this position the new set of backup rolls 6*b* is now in a waiting position and the roll receiving area 13 is positioned in a traveling-over and/or moving position relative to the roll-changing pit 1. Then, the old set 4*a* of work rolls to be replaced coming from the roll stand is moved by the locomotive 2 into the receiving area 13 and the upper support or moving area 15. In this position the set 4*a* of work rollers is then removed from the roll-changing stand 8 by the hall crane of the roll workshop. Moreover, it is possible in the waiting position, shown in FIG. 3, of the new set 6*b* of the backup rollers to move the old set 6*a* of backup rollers to be replaced along the roll-changing pit 1 coming from the roll stand into the roll receiving area 13 of the roll-changing stand 8. After the positioning of the old set 6*a* of backup rolls in the roll stand 8 the latter is now transversely pushed into the position shown in FIG. 4. It is now possible to move the new set 6*b* of backup rolls into the roll hall along the roll-changing pit to the roll stand, which pit is now in alignment with the roll receiving area 14.

During a replacement of a set of work rolls a new set 4*b* of work rolls is subsequently set, as is shown in FIG. 5, on the upper support—or moving area 16 of the roll receiving area 14 by the crane. This new set 4*b* of work rolls is then also pushed to the roll stand by the locomotive (not shown in FIG. 5) and can then be set into the roll stand.

The roll-changing stand 8 is subsequently moved into the position shown in FIG. 6, in which it is then possible to dismantle the old set 6*b* of backup rolls in the roll workshop. If a replacement of work rolls should again be necessary during the dismantling of the set 6*b* of backup rolls, the roll-changing stand 8 is again transversely shifted so that the receiving area 14 is brought with the roll-changing pit 1 into a traveling-over or moving position aligned for covering. The set of work rolls (old set 4*a* of work rolls) then moved by the locomotive 2 onto the upper support or moving area 16 of the roll receiving area 14 is lifted off with the crane. A new set 4*a* of work rolls is set thereafter over the same path by the roll workshop crane onto the upper support or moving area 16 of the roll receiving area 14 so that the latter can be moved by the locomotive 2 along the roll-changing pit 1 to the roll stand. The old set 6*b* of backup rolls in the position shown in FIG. 5 can subsequently be dismantled or also moved again into the position shown in FIG. 6 and further dismantled there.

The invention claimed is:

1. A device for handling and/or transporting at least in pairs, backup rolls (6*a*, 6*b*) and/or work rolls 4*a*, 4*b*) of a roll stand between the roll stand arranged in a roll hall and a roll workshop and in the roll workshop, the device comprising:

a roll-changing pit (1) running transversely to a rolling direction of the roll stand from the roll stand toward the roll workshop;

a locomotive (2) movable in the roll-changing pit (1) for moving at least a pair of dismounted backup rolls (6*a*, 6*b*) and work rolls (4*a*, 4*b*); and a roll-changing stand (8) movable in the roll workshop transversely to and across the roll-changing pit (1) in or counter to the rolling direction of the roll stand, wherein the roll-changing stand (8) has two receiving areas (13, 14) arranged at a distance from one another in the rolling direction of the roll stand and having a U-shaped cross-section, the receiving areas (13, 14) having support surfaces (15, 16) for receiving work rolls (4*a*, 4*b*) and support surfaces (17, 18) for receiving backup rolls (6*a*, 6*b*), and wherein the locomotive (2) is movable along the receiving areas (13, 14).

2. The device according to claim 1, wherein the roll-changing stand (8) is so displaceably supported on a bottom level of a pit (7) that a respective roll-receiving area (13, 14) can be brought in a traveling-over and/or moving position with respect to the roll-changing pit (1) and in which the locomotive (2) is moved in respective the roll-receiving area (13, 14).

3. The device according to claim 1, wherein the roll receiving areas (13, 14) are so spaced from each other that a respective pair of arranged one above another work and/or backup rolls (4*a*, 4*b*, 6*a*, 6*b*) can be simultaneously arranged therein next to each other.

4. The device according to claim 1, wherein the work roll support surfaces (15, 16) are arranged at a work roll changing level (20) of the roll stand and the backup roll support surfaces (17, 18) are arranged beneath the work roll support surfaces (15, 16) at a backup roll changing level (19) of the roll stand and at a displacement level of the roll-changing pit (1).

5. The device according to claim 1, wherein a bottom level of a workshop pit (7) is located below a bottom level of the roll-changing pit (1).

6. The device according to claim 1, wherein the roll-changing pit (1) has a displacement cross-section corresponding to a diameter of a backup roll.

* * * * *